US005603370A

United States Patent [19]

Boer

[11] Patent Number: 5,603,370

[45] Date of Patent: Feb. 18, 1997

[54] VERSATILE AND USER FRIENDLY HINGED DISPLAY SYSTEM

[76] Inventor: Edmond J. Boer, P.O. Box 292, Flesherton, Ontario N0C 1E0, Canada

[21] Appl. No.: 266,761

[22] Filed: Jun. 27, 1994

[51] Int. Cl.[6] ..... A47G 5/00

[52] U.S. Cl. ..... 160/135; 160/231.1; 52/239

[58] Field of Search ..... 160/135, 351, 160/231.1; 52/239; 16/225, 366, DIG. 13; 40/589, 649, 611, 152; 411/408, 401

[56] References Cited

U.S. PATENT DOCUMENTS

| | | | |
|---|---|---|---|
| 2,350,617 | 6/1944 | Johnson | 40/611 X |
| 2,406,729 | 8/1946 | White et al. | 160/119 |
| 3,630,309 | 12/1971 | Wenger | 160/135 X |
| 3,817,396 | 6/1974 | Markson | 160/135 X |
| 3,889,736 | 6/1975 | Firks | 160/135 |
| 3,913,656 | 10/1975 | Guyer | 160/135 |
| 4,134,439 | 1/1979 | Scott | 160/135 |
| 4,263,761 | 4/1981 | Kristoff | 52/241 |
| 4,375,829 | 3/1983 | Dorr et al. | 160/135 |
| 4,436,135 | 3/1984 | Ytter | 160/135 |
| 4,448,003 | 5/1984 | Hasbrouck | 52/239 |
| 4,491,166 | 1/1985 | Hanna | 160/351 |
| 4,610,560 | 9/1986 | Miller | 16/366 X |
| 4,619,304 | 10/1986 | Smith | 160/135 |
| 4,722,146 | 2/1988 | Kemeny | 160/135 X |
| 4,823,858 | 4/1989 | Perutz | 160/135 |
| 4,865,111 | 9/1989 | Perutz | 160/135 |
| 4,891,922 | 1/1990 | Hozer et al. | 52/239 |
| 4,924,931 | 5/1990 | Miller | 160/135 |
| 4,958,671 | 9/1990 | Bove | 160/135 |
| 4,979,554 | 12/1990 | Nelson | 160/135 |
| 4,986,038 | 1/1991 | Backer | 52/71 |
| 5,131,448 | 7/1992 | Miller | 160/135 |
| 5,431,210 | 7/1995 | Nelson et al. | 160/135 |

FOREIGN PATENT DOCUMENTS

| | | | |
|---|---|---|---|
| 2203190 | 10/1988 | United Kingdom | 15/225 |
| 9112402 | 8/1991 | WIPO | 16/225 |

*Primary Examiner*—Blair Johnson

*Attorney, Agent, or Firm*—Hodgson, Russ, Andrews, Woods & Goodyear LLP

[57] ABSTRACT

A versatile and user friendly display system. First and second sets of panel frames and a plurality of header frames are interchangeably connected so that the header frames are optionally above, between, or below the first and second sets of panel frames. The frame segments are connected by key members to allow relatively easy field repair and the adding or subtracting of additional frames. A hinge for hingedly connecting a pair of frames comprises at least one pair of straps composed of a flexible material. One strap is attached to the front edge of an elongate segment of one frame and the rear edge of an elongate segment of the other frame. The other strap is attached to the rear edge of the elongate segment of the one frame and the front edge of the elongate segment of the other frame. The attachment of the straps to the front edges defines a hinge axis about which the frames are rotatable through a first arc, and the attachment of the straps to the rear edges defines a hinge axis about which the frames are rotatable through a second arc. At least one elongate segment of a frame is formed as two parts wherein a first elongate member serves as a tie bar between a pair of frame segments and is adapted to provide an opening for insertion of a panel, and a second elongate member is removably attachable to the first elongate member and closes the opening to prevent insertion and removal of panels.

16 Claims, 10 Drawing Sheets

VERSATILE AND USER FRIENDLY HINGED DISPLAY SYSTEM

The present invention relates generally to panel display structures for trade show exhibition booths and the like.

Various types of display systems-have been provided wherein the display panels are supported by various kinds of pins, connectors, and hinges. See, for example, U.S. Pat. Nos. 2,406,729, 3,889,736, 3,913,656, 4,134,439, 4,263,761, 4,375,829, 4,448,003, 4,491,166, 4,619,304, 4,823,858, 4,865,111, 4,891,922, 4,924,931, 4,958,671, 4,979,554, and 4,986,038.

A display system may typically comprise a plurality of rectangular panel frames hinged together so that they may be folded along vertical axes for storage and transport. Typical metallic hinges placed on the frames would undesirably be conspicuous and not provide a seamless effect. If the unit is forced in the wrong direction, such a metallic hinge may be susceptible to becoming bent.

U.S. Pat. No. 4,823,858 to Perutz discloses a hinged display system wherein each hinge permits 360 degrees relative rotational movement between adjacent panels. Each hinge comprises first and second hinge segments secured to adjacent first and second display panels. Each hinge segment includes upper, middle, and lower portions that are arranged in vertically spaced relation. The hinge segments are interconnected by a pair of link pieces. One link piece is pivotally connected to the upper and middle portions of the segments and the second link piece is pivotally connected to the middle and lower portions of the segments. When one segment pivots 180 degrees relative to the other segment, one pivot axis is utilized, and, when the one segment pivots through a second arc of 180 degrees, a second pivot axis is utilized. When the adjacent panels are disposed in a substantially coplanar relation, the hinges are said to be substantially concealed. Such a structure is expensive to manufacture.

U.S. Pat. No. 4,619,304 to Smith discloses a hinged structure wherein supports are hinged together. The hinge comprises two members each made of a resiliently flexible strip material such as a spring stainless steel. Each member is S-shaped and passes partially around each support, and the two members together form a letter X or FIG. 8 configuration The members are fastened alongside each support so that the members are tensioned round the supports.

A display system may, for example, comprise two or more sets of hinged panels and a set of header panels disposed at the top of the structure. Header panels may be positioned between a pair of hinged panels as an accent stripe, as seen in U.S. Pat. No. 4,865,111 to Perutz. It is considered desirable to have the versatility to interchange the header panels with the sets of hinged panels so that they serve optionally as a header or an accent stripe or are disposed at the bottom of the structure.

Each of the elongate segments of a frame is typically a single piece which comprises a central portion and a pair of flange portions at each edge extending inwardly from an outer surface over the segment length, a panel being insertable between the central portion and each of the flange portions. Such a construction requires removal of an elongate segment for insertion or removal of a panel. A segment is typically removably attached by means of spring-loaded bullets in holes, requiring the use of one's finger to apply enough force against the bullets to disconnect the segment. It is difficult to insert a finger to push on the bullet and therefore difficult to remove the segment.

It is accordingly an object of the present invention to provide a lightweight portable display system which is cost effective for the end user.

It is another object of the present invention to provide such a display system which is versatile, i.e., it may be converted and used optionally as three separate systems, wherein the header frames may be provided at the top as a header, at the middle as an accent stripe, or at the bottom.

It is a further object of the present invention to provide such a display system wherein the hinges are not subject to breakage and allow relative rotation throughout substantially 360 degrees and are inconspicuous so as to effect a seamless appearance.

It is yet another object of the present invention to provide such a display system wherein the hinges may be installed inexpensively, yet are rugged and reliable.

It is another object of the present invention to provide such a display system which allows the panels to be easily and quickly replaced.

In accordance with the present invention, first and second sets of panel frames and a plurality of header frames are interchangeably connectable so that the header frames are optionally above, between, or below the first and second sets of panel frames.

Also in accordance with the present invention, a hinge for a pair of panel frames comprises at least two straps composed of a flexible material. One of the straps is attached to the front edge of one frame segment and the rear edge of the other frame segment, and the other strap is attached to the rear edge of the one frame segment and the front edge of the other frame segment so that the attachment of the straps to the front edges defines a hinge axis about which the frames are rotatable through a first arc, and the attachment of the straps to the rear edges defines a hinge axis about which the frames are rotatable through a second arc. Cut-outs are provided in the segments, and a complementary insert effects pinching of the respective strap end portion within each cut-out between the respective segment and the insert, which may then be tightly connected for securely attaching the strap.

Further in accordance with the present invention, at least one of the frame segments in formed as two parts wherein a first elongate member serves as a tie bar between a pair of segments and is adapted to provide an opening for insertion of a panel, and a second elongate member is removably attachable to the first elongate member and closes the opening to prevent insertion and removal of panels.

The above and other objects, features, and advantages of the present invention will be apparent in the following detailed description of a preferred embodiment thereof when taken in conjunction with the accompanying drawings wherein the same reference numerals denote the same or similar parts throughout the several views.

DETAILED DESCRIPTION OF THE PREFERRED EMBODIMENT

Figure 1:
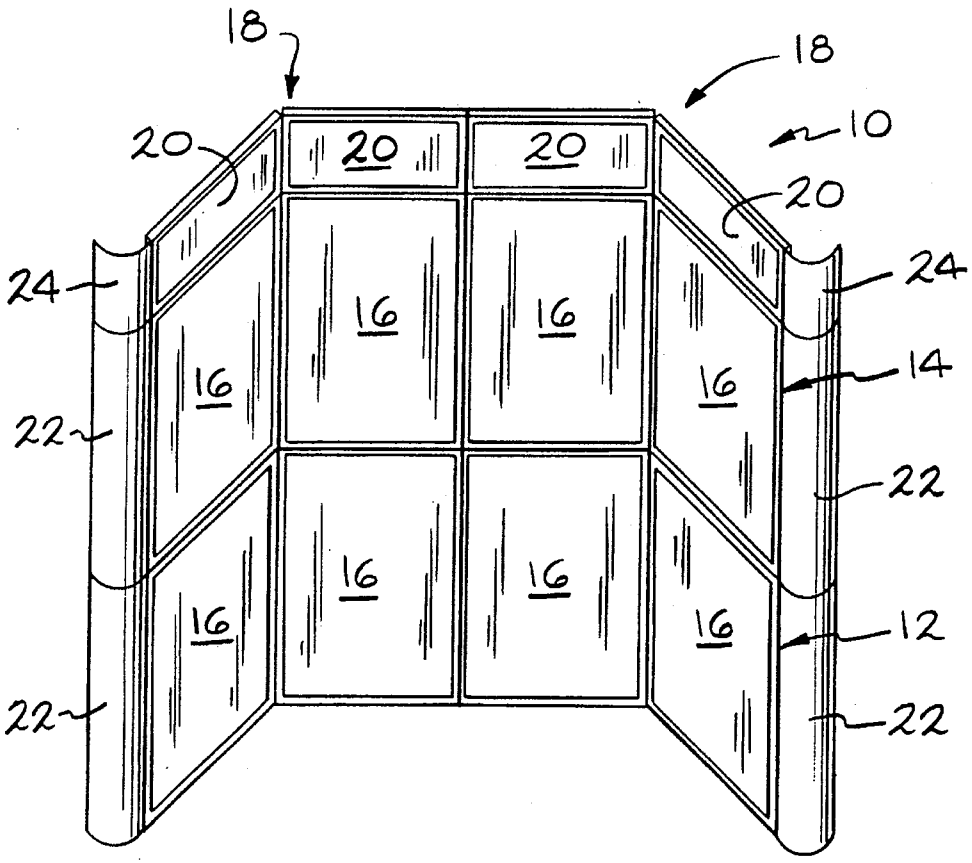
FIG. 1 is a perspective view of a panel display system, shown set up for viewing, which embodies the present invention.

Referring to FIG. 1, there is shown generally at 10 a panel display system set up for display at a trade show or the like. The display system 10 comprises a first or lower set 12 of four panels 16 hingedly connected together for ease of set-up, takedown, and transport. The system 10 also comprises a second or upper set 14 of four panels 16 similarly hinged together. The system 10 further comprises two pairs 18 of header panels 20 each pair hingedly connected together as hereinafter described relative to panels 16.

Figure 2:
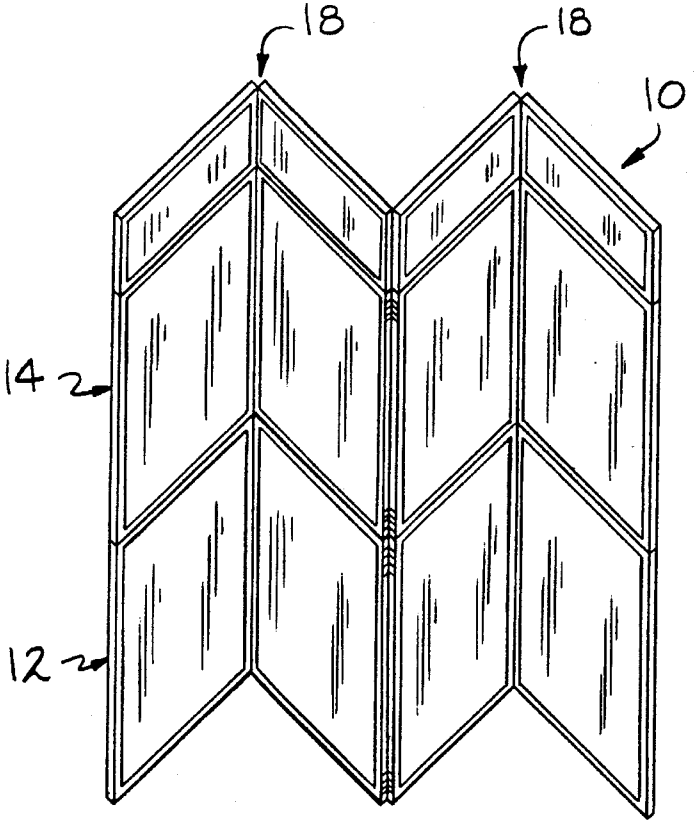
FIG. 2 is a view similar to that of FIG. 1 showing the panels partially folded up.
Figure 5:
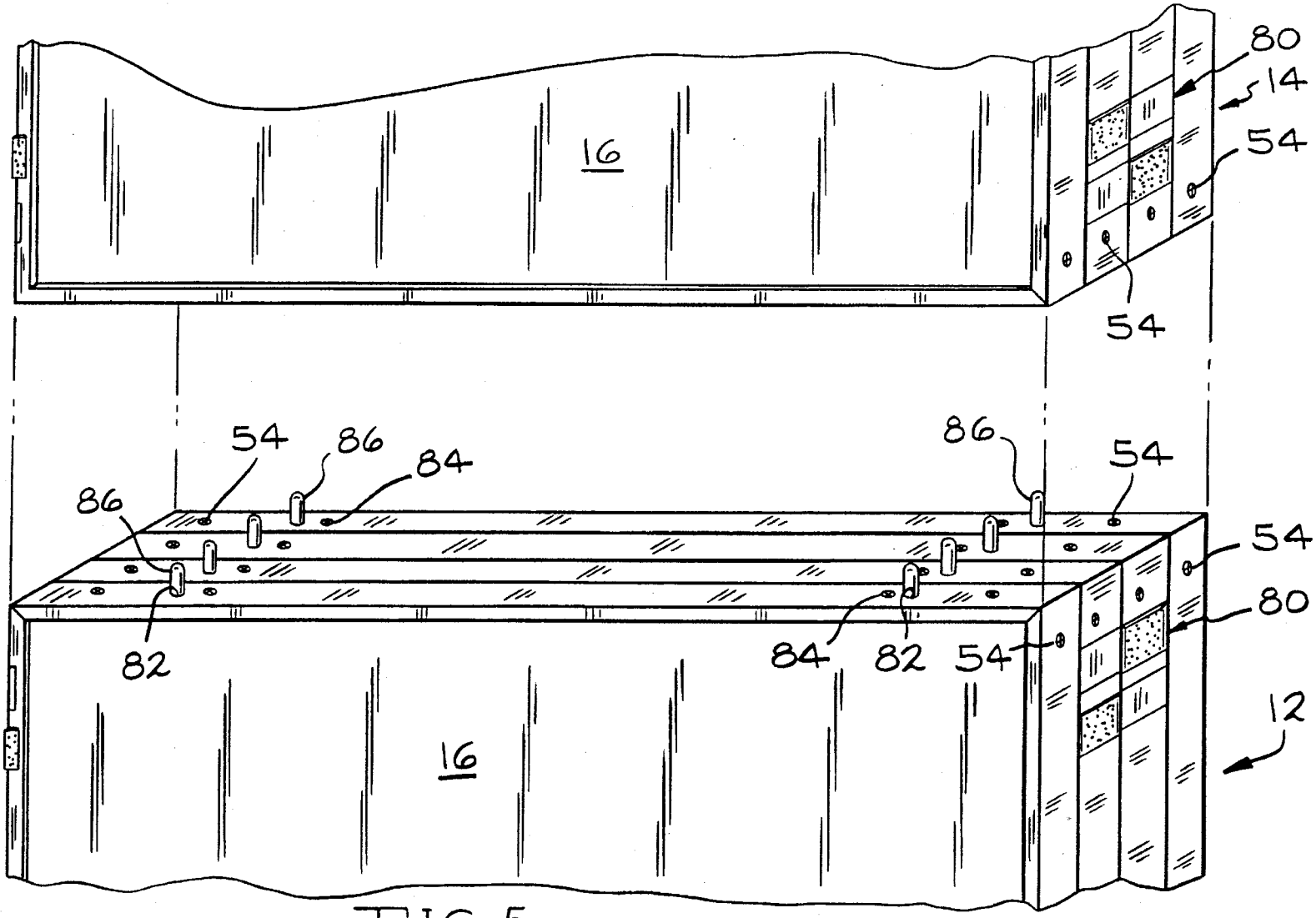
FIG. 5 is a partial perspective view showing the sets of panel frames of the display system folded up.

The sets of panels 16 and the pairs of header panels 20 are foldable, as illustrated in FIG. 2, into a face-to-face and back-to-back relation for transport and storage, the sets 12 and 14 of panels being shown folded in FIG. 5. The folded sets 12 and 14 of panels may be packed by laying one on top of the other in a shipping container. Dividing the header panels 20 into two pairs allows efficient use of the shipping container space in that the folded pairs of header panels 20 may be laid side-by-side on top of the sets 12 and 14 of panels. In order to achieve such efficient packing, the header panels 20 desirably have less than half the height of the panels 16. For example, each header panel 20 may perhaps have a width of about 40 inches and a height of about 12 inches, while each panel 16 may have the same width and a height of perhaps about 28 inches.

The sides of the display system 10 may be provided with trim assemblies such as curved panels 22 and 24 connected to edges of the outer ones of the panels 16 and 20 respectively. Since these trim assemblies, which are not shown in FIG. 2, do not form any part of the present invention, they are not described further herein.

Figure 7:
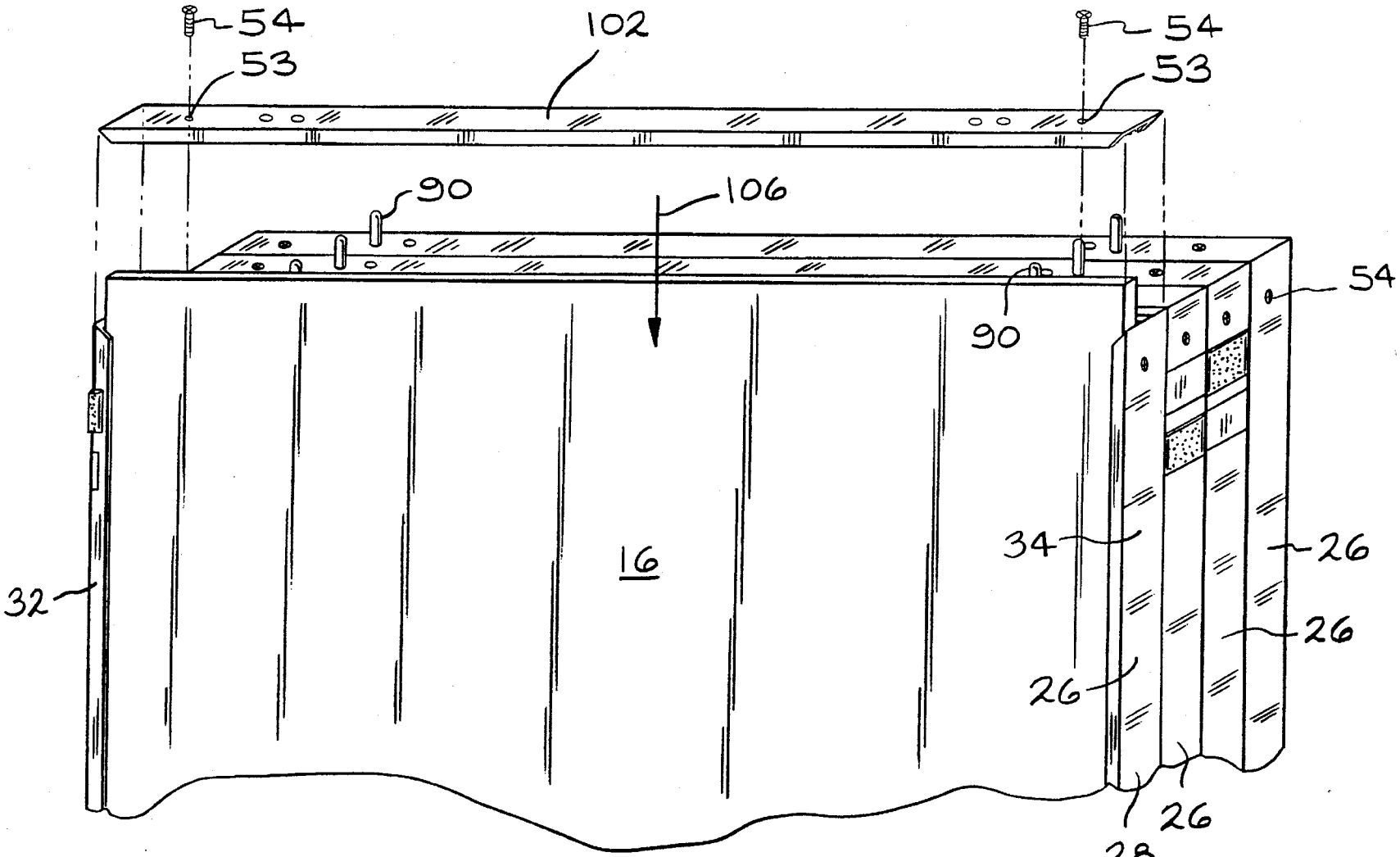
FIG. 7 is a view similar to that of FIG. 6 showing the panel frames with a panel being inserted therein.

As seen in FIG. 7, the panels 16, which are generally inflexible and typically rectangular and composed, for example, of a thin light weight material weighing perhaps about 1 pound and having a thickness of perhaps about 3/16 inch, are held along their edges by rectangular (or otherwise complementary in shape) frames 26 which are composed of extruded segments of lightweight material, such as aluminum, which are suitably joined together, as described hereinafter, to form a strong rigid frame having miter joints, i.e., the ends of the segments are chamfered at an angle of 45 degrees, as illustrated at 27 in FIG. 3, to mate with similarly chamfered ends of other segments.

Figure 3:
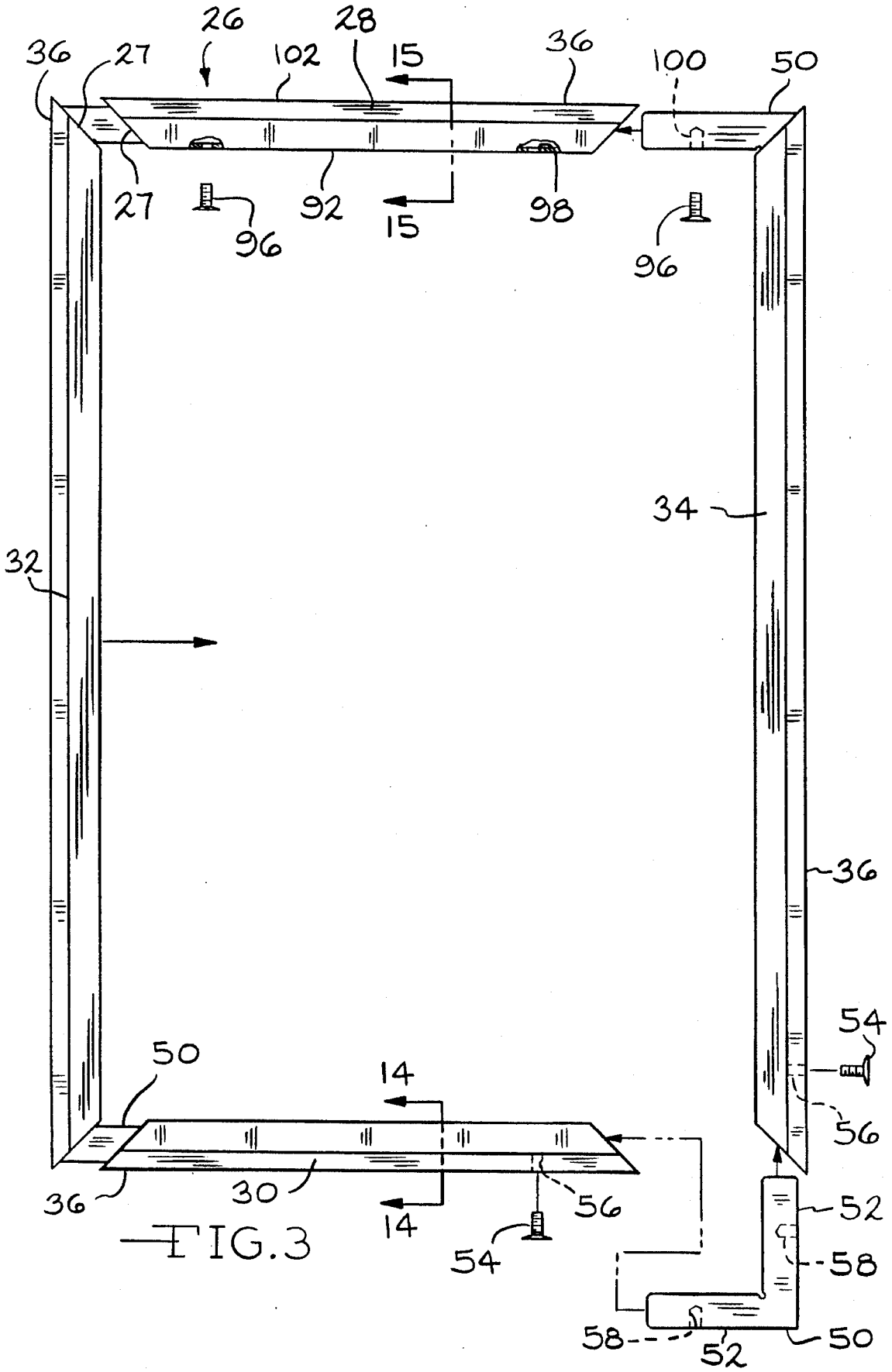
FIG. 3 is a partially exploded view of one of the panel frames of the display system.

One of the frames 26 is shown in FIG. 3. Frame 26 includes upper and lower elongate segments 28 and 30 respectively joined to longer elongate side segments 32 and 34. Conventionally, frame segments have been joined by a swaged or crimped joint that cannot be disssembled. In accordance with the present invention, the frame segments are joined by L-shaped key members 50 so as to allow relatively easy field repair and the adding or subtracting of additional frames. The segments and key members may be extruded aluminum or composed of other suitable material. Each key member 50 has two legs 52 oriented at a right angle to each other.

Figure 14:
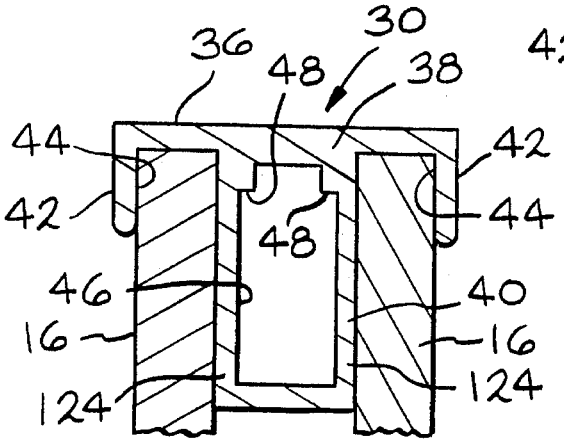
FIG. 14 is a sectional view, taken along lines 14—14 of FIG. 3, of the lower frame segment of the frame of FIG. 3.

A sectional view of lower segment 30 is shown in FIG. 14, the sectional views of segments 32 and 34 being the same except that if one of the segments 32 and 34 is hingedly connected to a segment of an adjoining frame, it will be modified as discussed hereinafter. However, if desired, one or more of these segments may be similar to upper segment 28, which will be described hereinafter. Referring to FIG. 14, segment 30 has an outer surface 36 defined by a generally planar portion 38. Extending inwardly from portion 38 is a generally rectangular central portion 40 and a pair of flange portions 42, the flanges 42 extending from the elongate edges respectively of portion 38 and being generally parallel to sides of the central portion 40 whereby the edges of panels 16 are held within the spaces or grooves, illustrated at 44, between the flange portions 42 respectively and the respective sides of the central portion 40 over the entire perimeter of the frame 26. The segment 30 is formed to have an elongate generally rectangular channel 46 extending from end to end through the length of the central portion 40. The channel 46 is formed to be narrowed adjacent portion 38 over the length of segment 30 to define a pair of shoulders 48. The legs 52 of a key member 50 are received within the channels 46 respectively of a pair of frame segments to be joined. The legs 52 are sized to fit snugly within the respective channels 46 and abutting the shoulders 48. A leg 52 is secured to the respective segment by a suitable flat head screw, illustrated at 54, which is received in an aperture, illustrated at 56, in segment portion 38 and is threadedly received in a threaded aperture, illustrated at 58, in the leg 52. Apertures 56 are countersunk for receiving the screw heads. While representative screws and the like are shown in the drawings, it should be understood that all such screws and the like may not be shown but may be ascertained from the description and the drawings, utilizing principles commonly known to those or ordinary skill in the art to which this invention pertains.

Figure 4:
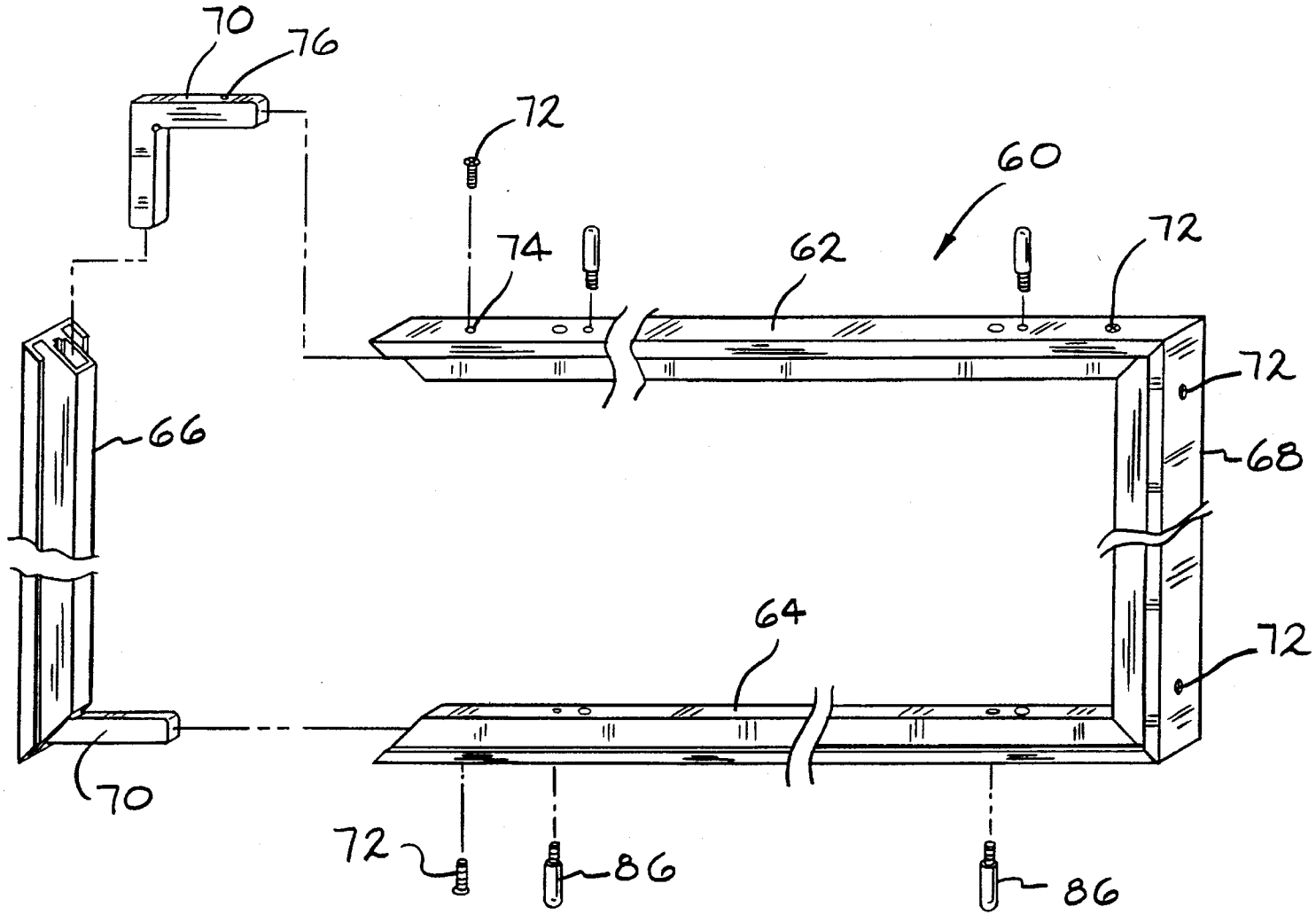
FIG. 4 is a partially exploded view of one of the header frames of the display system.

Referring to FIG. 4, a frame for a header 20 is shown generally at 60. The header frame 60 is constructed of relatively long upper and lower frame segments 62 and 64 respectively, relatively short side segments 66 and 68, and key members 70 which may be similar to frame segments 28, 30, 32, and 34 respectively and key members 50. The key members 70 may be similarly attached to the segments by screws 72, which may be similar to screws 54, received in countersunk apertures, illustrated at 74, in the respective segments and threadedly received in threaded apertures, illustrated at 76, in the key members 70. Unless otherwise specified herein, header frames 60 may be similar to, but smaller in size than, frames 26. Descriptions hereinafter with respect to panel frames 26 are therefore also applicable to header frames 60, which contain header panels 20.

Referring to FIG. 5, hinges are shown generally at 80 connecting the middle two of the four panel frames 26 of each of the lower and upper sets 12 and 14 respectively. There may be perhaps 4 to 8 hinges 80 spaced along the length of the respective segments for hingedly connecting a pair of frames. The first and second frames and the third and fourth frames for each set are similarly connected by hinges 80 on the left side as seen in FIG. 5, and these hinges are therefore not shown. The hinged connections of the frames allow them to be folded so as to overlie each other compactly in face-to-face and back-to-back relation as shown in FIG. 5 for storage and transport.

Figure 6:
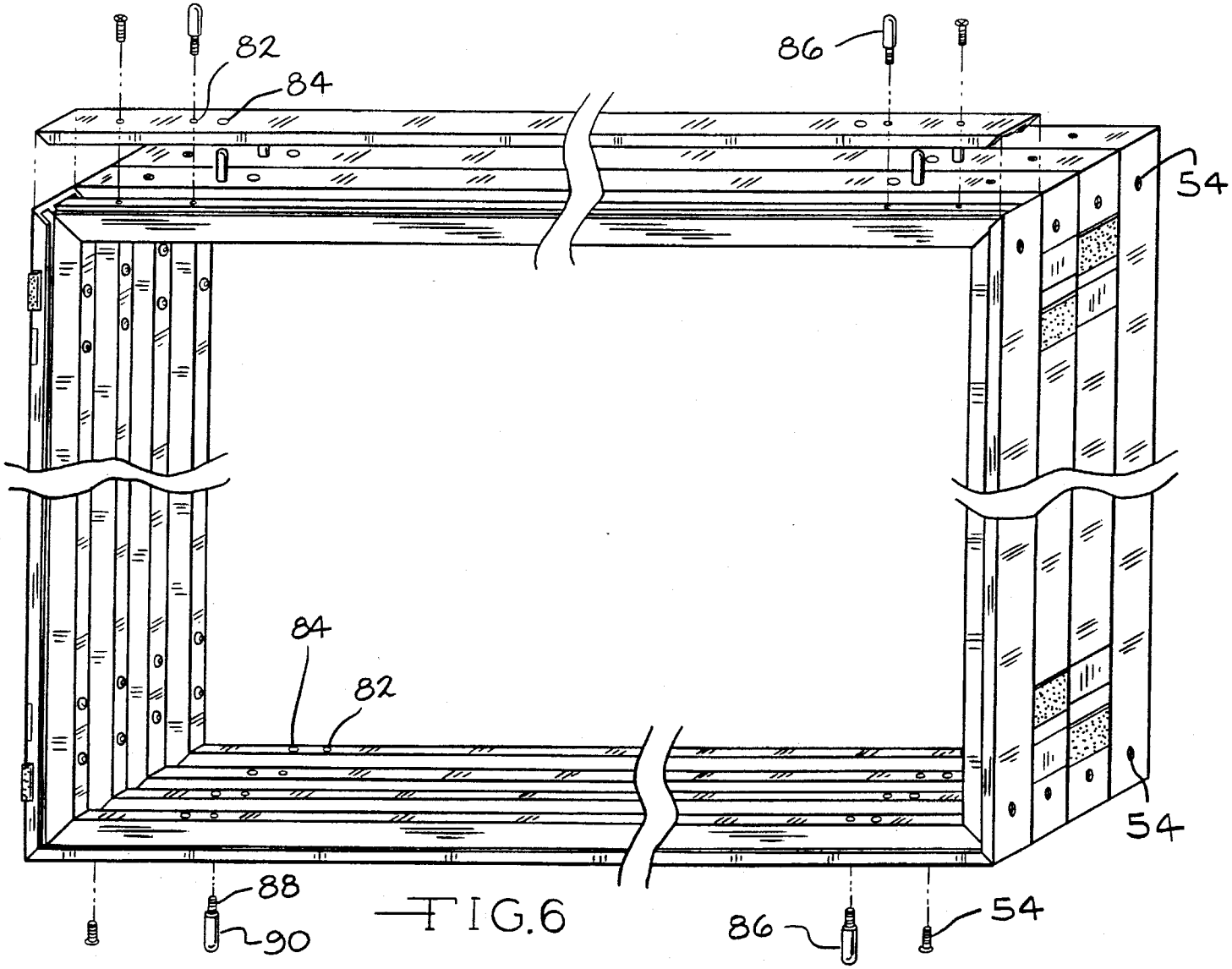
FIG. 6 iS a perspective view showing a set of panel frames of the display system folded up and illustrating removal of a cap member so that a panel may be inserted.
Figure 13:
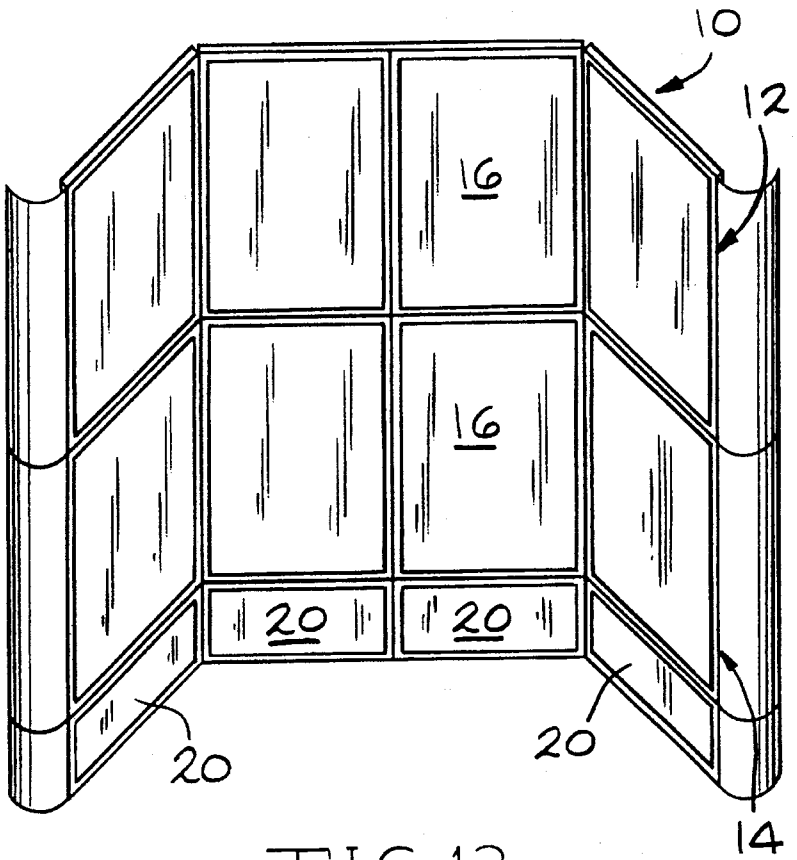
FIG. 13 is a view similar to that of FIG. 1 showing the header frames below the two sets of panel frames.
Figure 12:
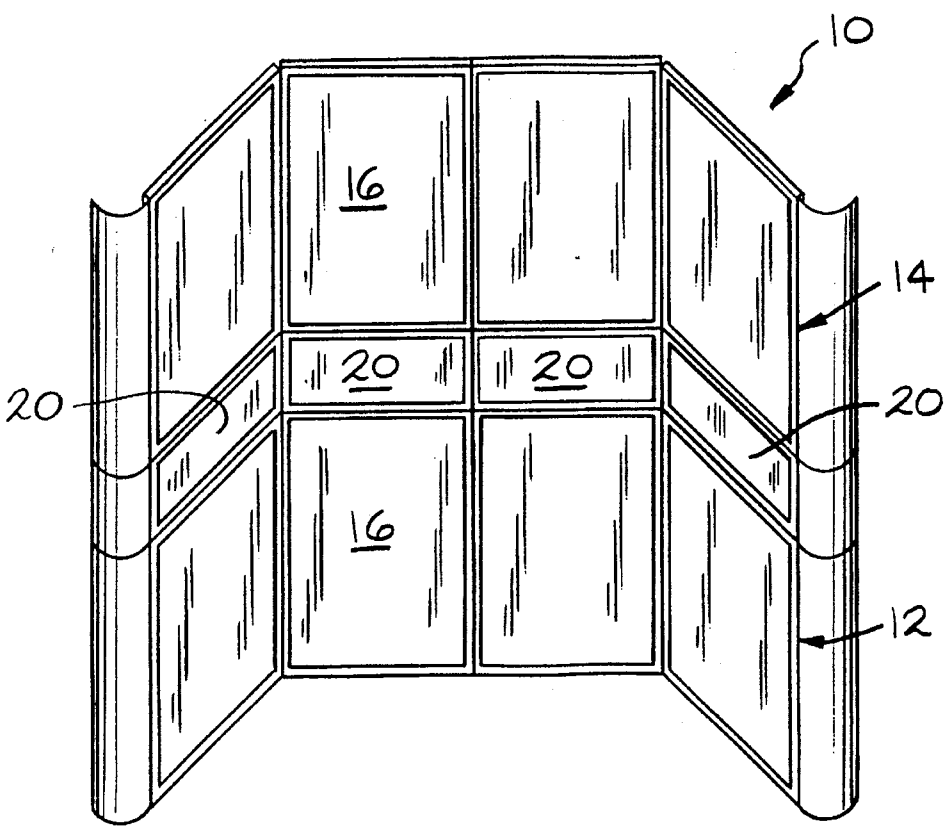
FIG. 12 iS a view similar to that of FIG. 1 showing the header frames between the two sets of panel frames.

In order that the lower and upper panel sets 12 and 14 respectively may be easily connected interchangeably with each other and with the headers 20, in accordance with the present invention, each end portion of each of the upper and lower segments 28 and 30 respectively of both the lower and upper sets 12 and 14 respectively of frames as well as each end portion of each of the upper and lower segments 62 and 64 respectively of header frames 60 is provided with a threaded aperture 82 and an unthreaded aperture 84. Each of the apertures 82 and 84 extends entirely through the respective segment including portion 38 and central portion 40. Threaded apertures 82 are positioned on lower segments to be in alignment with unthreaded apertures 84 on upper segments to which a panel frame is to be joinable and are positioned on upper segments to be in alignment with unthreaded apertures 84 on lower segments to which a panel frame is to be joinable. Pins 86 have threaded end portions 88 (FIG. 6) which are threadedly received in the threaded apertures 82 and shank end portions 90 which extend outwardly from the outer surfaces 36 of the respective segments. The shank portions 90 are snugly received in the correspondingly aligned unthreaded apertures 84 in an upper or lower segment of a frame to which a frame containing the pins 86 is to be mounted. Thus, as shown in FIG. 6, the threaded apertures 82 in each end portion of the upper segments of both panel frames and header frames are located outwardly of the unthreaded apertures 84, and the threaded apertures 82 in each end portion of the lower segments of both panel frames and header frames are located inwardly of the unthreaded apertures 84 so as to be in alignment with corresponding unthreaded apertures 84 in upper segments of both panel frames and header frames. To mount any combination of panel and header frames together, the shanks 90 of the pins 86 threadedly secured to a segment of one frame are received in corresponding aligned unthreaded apertures 84 of the corresponding segment of the other frame, and the shanks 90 of the pins 86 threadedly secured to the corresponding segment of the other frame are received in the corresponding aligned unthreaded apertures 84 of the one frame. This allows a display to be easily set up with the headers 20 interchangeably at the top, as shown in FIGS. 1 and 2, or between the lower and upper sets 12 and 14 respectively of panels, as shown in FIG. 12, to be an accent stripe, or at the bottom, as shown in FIG. 13. FIG. 13 also shows panel set 12 interchangeably positioned above panel set 14. If desired, the panel assembly 10 may be divided into two table-top displays.

As seen in FIG. 5, the sets 12 and 14 of panels are preferably stacked with the hinged sides matching, the pins 86 sticking up from the lower set and sticking down from the upper set.

Figure 15:
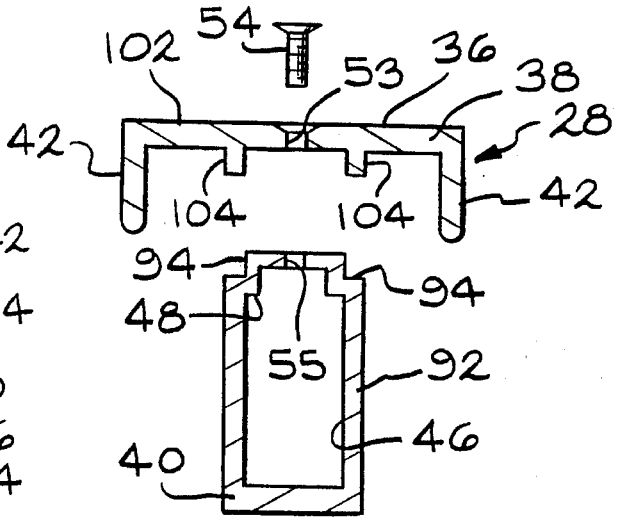
FIG. 15 is a section view taken along lines 15—15 of FIG. 3, of the upper frame segment of the frame of FIG. 3 with the segment shown in an exploded view.

As seen in FIG. 14, an edge of a panel 16 is held between a flange portion 42 and the central portion 40 of a segment. Such a construction has conventionally required a segment to be detached from the frame for insertion and removal of a panel, but it is considered difficult to insert a finger into a hole to push on a spring-loaded bullet to remove a segment. Referring to FIGS. 6 and 15, in order to more easily insert or remove a panel, in accordance with the present invention, the upper segment 28 or other suitable segment comprises two elongate pieces. One piece 92, which may be called the tie bar, is generally rectangular in cross section and contains a central portion 40 including channel 46 and shoulders 48. The outer longitudinal edges of the tie bar 92 have notches 94, i.e., right-angled longitudinal cut-outs.

The tie bar 92 is suitably connected to side segments 32 and 34 such as by screws 96 (illustrated in FIG. 3) which are received in apertures, illustrated at 98, in the inner portion of the tie bar 92 and threadedly received in threaded apertures 100 in the respective key members 50 so that the tie bar may be left permanently connected.

The second piece 102 of the upper segment 28, which may be called a top cap, contains a planar portion 38 including outer surface 36 and flange portions 42 A pair of longitudinal ridges 104 on the inner surface of portion 38 are provided to mate with notches 94 for seating the top cap 102 on the tie bar 92 with portion 38 flush with the outer surface of the tie bar 92.

The top cap 102 is removably connected to tie bar 92 by the screws 54 (one in each end portion) received in countersunk apertures 53 in the top cap 102 and apertures 55, which extend through the outer portion of the tie bar 92, and are threadedly received in threaded apertures 58 in the key members 50 respectively. Apertures 53 and 55 together correspond to apertures 56 in the single-piece frame segments.

Referring to FIG. 7, the top cap 102 may be easily and quickly removed and re-connected by respectively removing and reapplying the two screws 54. With the top cap 102 removed, whereby the flanges 42 are removed, the panel 16 may be easily and quickly inserted or removed, as illustrated by arrow 106.

Figure 8:
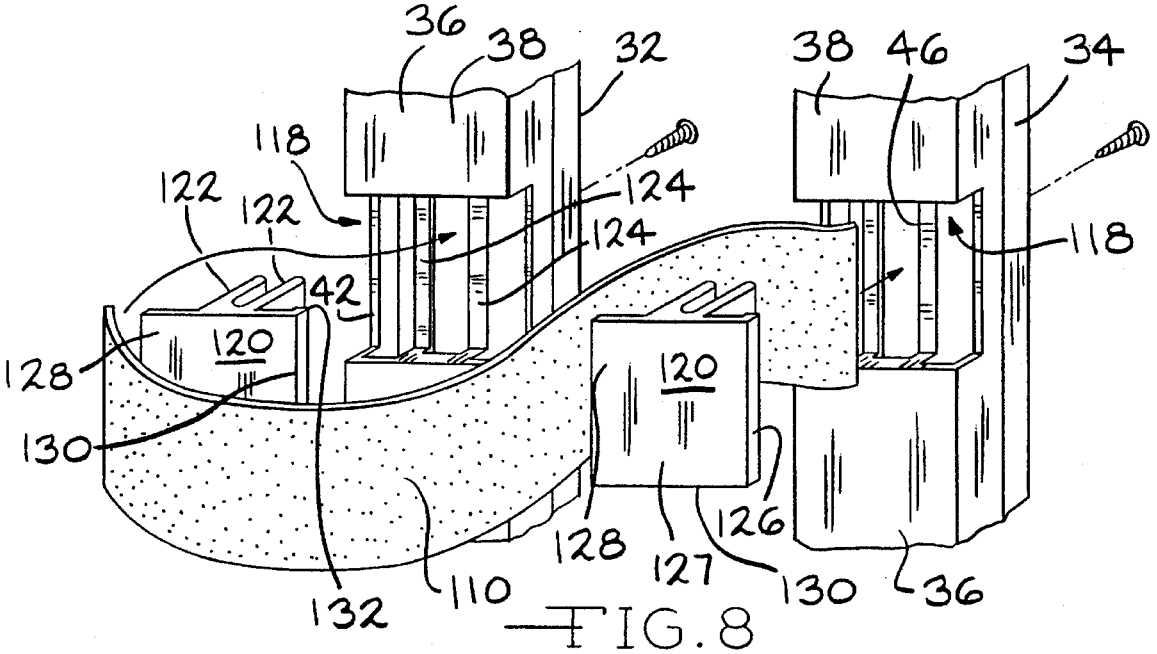
FIG. 8 is an exploded view of half of a hinge for a pair of the panel frames illustrating attachment of a strap.
Figure 9:
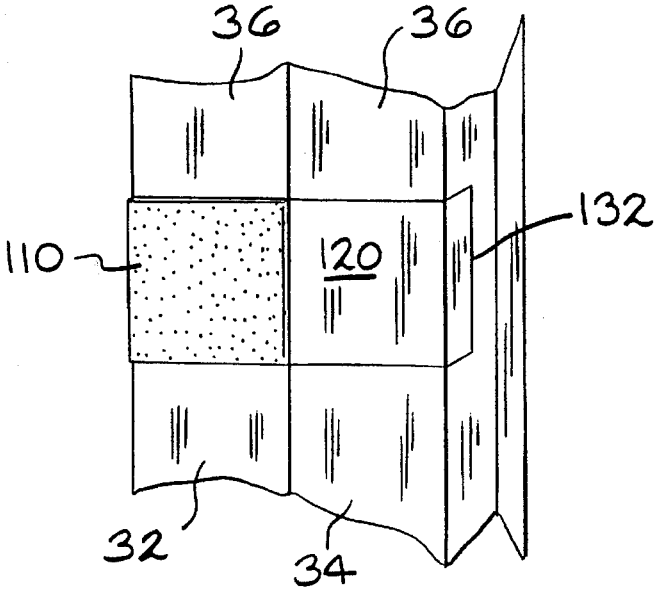
FIG. 9 is a partial side view of the hinge half, when the frames are in a folded condition, with the strap attached.
Figure 16:
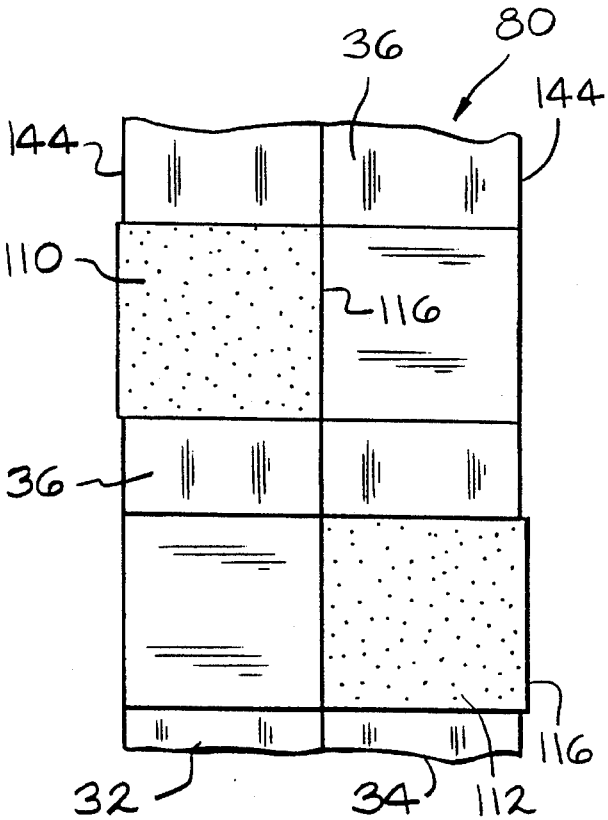
FIG. 16 is a view similar to that of FIG. 9 showing both halves of the hinge and with the frames in a folded condition.
Figure 17:
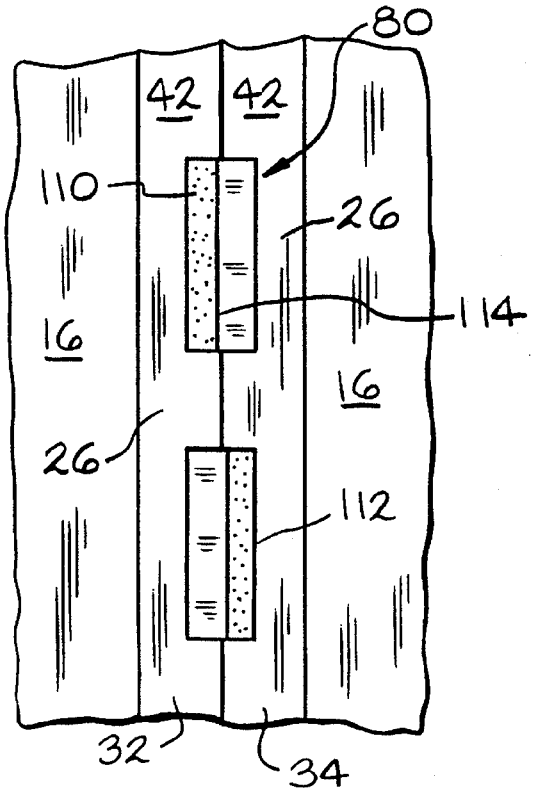
FIG. 17 is a partial front view of the hinge and respective frames in an unfolded condition and the panels inserted.

Referring to FIGS. 16 and 17, in order that the hinges 80 may allow rotation of one panel relative to another through substantially 360 degrees without being subject to breakage and while being inconspicuous to effect a seamless appearance, in accordance with the present invention, the hinge 80 is comprised of first and second longitudinally-spaced flexible straps 110 and 112 respectively. The frame segment 32 in FIGS. 16 and 17 as well as FIGS. 8 and 9 is understood to be of a first panel frame, and the frame segment 34 is understood to be of a second panel frame to which the first panel frame is attached. The straps 110 and 112 provide a first hinge axis illustrated at 114, for relative rotation through a first arc of substantially 180 degrees. The straps 110 and 112 also provide a second hinge axis, illustrated at 116, for relative rotation through a second arc of substantially 180 degrees.

Referring to FIGS. 8 and 9, there is shown the half of the hinge 80 containing the first strap 110, the second strap 112 being connected to the hinge segments similarly. Straps 110 and 112 are composed of vinyl material or other suitable cloth or material which is flexible to allow relative rotation between the panels.

In order to attach the strap 110, an outer section of each segment 32 and 34 including the portion 38 and outer portions of flanges 42 and the outer part of the central portion 40 just short of the shoulders 48 is removed over a distance longitudinally of the segment equal to the width of the strap, as illustrated by the cut-out 118. The width of the strap 110 may, for example, be equal to the width of portion 38 in which case the cut-out 118 may be substantially square. A member 120 is extruded or otherwise suitably formed to have a plate portion 126 which is complementary to, i.e., conforms to the shape of the cut-out 118. Thus, the surface 127 of plate 126 conforms or is complementary to and replaces the portion of surface 36 removed as a result of the cut-out 118. The member 120 also has a pair of spaced leg portions 122. The member 120 is adapted to be press fit into the cut-out space with the leg portions 122 extending inwardly between the walls 124 of the central portion 40, i.e., within the channel 46.

With the frames 32 and 34 side-by-side or face-to-face as shown in FIGS. 8, 9, and 16, one end of the strap 110 is tucked and pinched between one side 128 (the left side) of plate 126 and the corresponding flange 42 and wall 124 of segment 32. Since the strap 110 is not inserted between the other side 130 and the other flange 42, a rib 132 is provided along the edge of the other side 130 to extend inwardly a distance equal approximately to the thickness of the strap 110 to provide uniform closure of the cut-out 118. One end of the strap 110 is thus inserted at the left or outboard side (outboard relative no the other segment 34) of portion 38 of segment 32, as seen in FIG. 8. The strap 110 curves around and over portion 38, i.e., over member 120, and its other end is tucked and pinched between one side 128 (the left side) of plate 126 and the corresponding flange 42 and wall 124 of segment 34. Thus, the strap 110 is resultingly seen in FIG. 9 extending across the segment 32 but not across segment 34.

Figure 10:
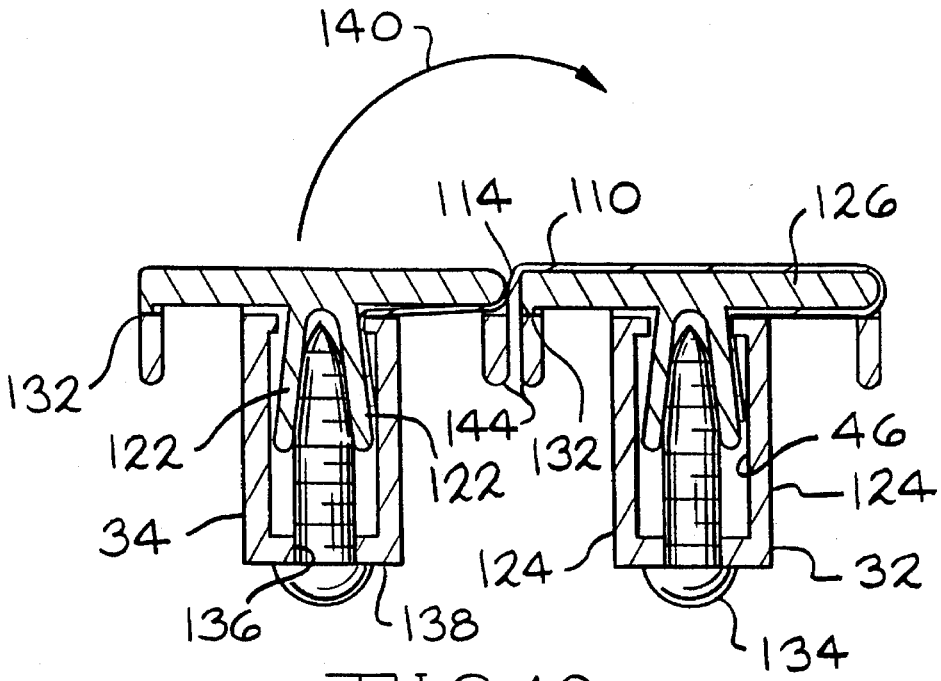
FIG. 10 is a horizontal sectional view thereof with the frames in a folded condition.
Figure 11:
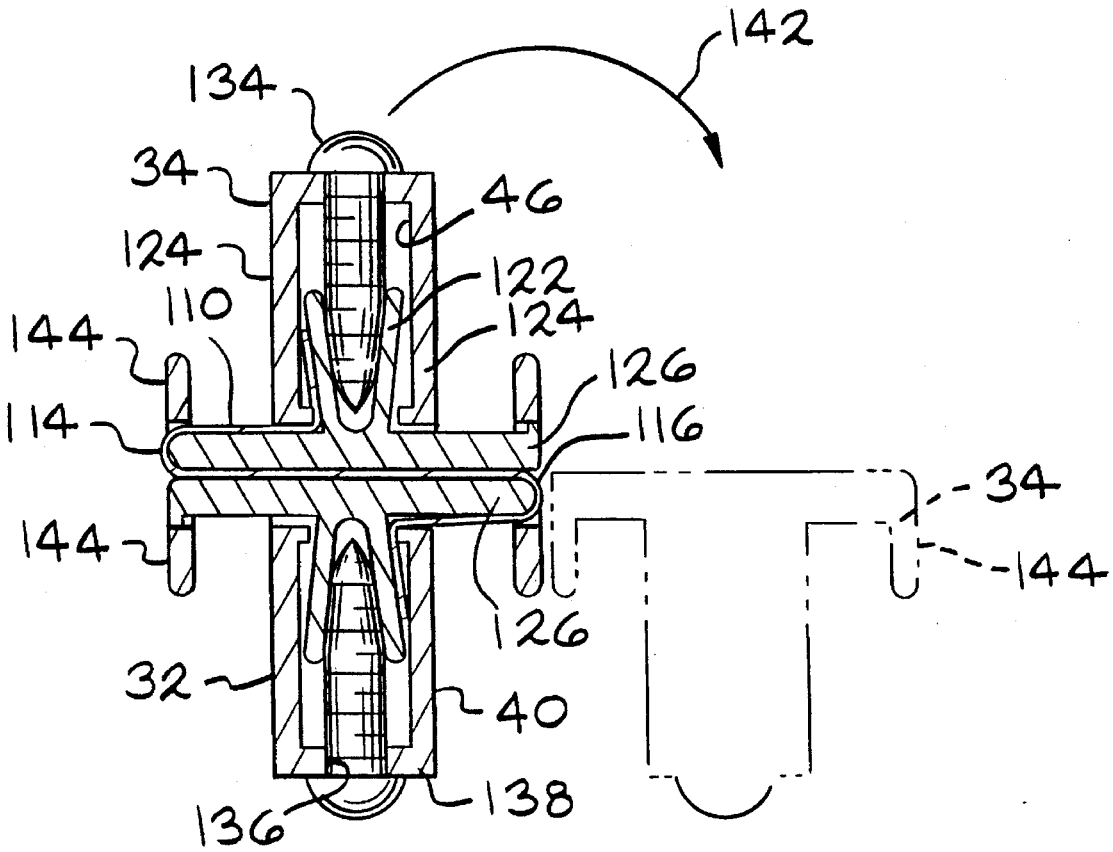
FIG. 11 is a view similar to that of FIG. 10 with the frames in an unfolded condition.

Referring to FIGS. 10 and 11, a round-head screw 134 is threadedly received in a threaded aperture, illustrated at 136, in the inner wall 138 of central portion 40 and is received in the channel 46 between the leg portions 122 forcing them apart and against walls 124 to secure the member 120 in pinching engagement with the strap 110.

FIG. 16 shows both straps 110 and 112 of the hinge 80 with the frames in the side-by-side relation shown in FIGS. 8 and 9. As seen in FIG. 16, while the first strap 110 is pinchingly attached to the left sides of the segments 32 and 34, the second strap 112 is pinchingly attached to the opposite or right sides of the segments 32 and 34. The straps 110 and 112 are provided to extend tautly (without any excess slack) between their points of attachment. Two or more hinges 80 along the length of the segments being attached, as seen in FIG. 6, will serve to stabilize the hinge function.

Referring again to FIGS. 10 and 11, the panel containing frame segment 34 is shown to rotate, as illustrated by arrow 140, relative to the other panel frame about first hinge axis 114 through an arc of substantially 180 degrees to the position shown in FIG. 11, which position is also shown in FIG. 17. Continued relative rotation of the frame containing segment 34, as illustrated by arrow 142, is about the second hinge axis 116 through another arc of substantially 180 degrees to the position shown in phantom lines in FIG. 11. Thus, relative frame rotation is through a total arc of substantially 360 degrees.

The hinged panel frames 26 are shown in an unfolded condition for display in FIG. 17 with the respective flanges 42 facing the viewer. The hinge 80 is generally flush with the frames, and the hinge 80 allows the flanges 42 of the adjacent frames 26 to be flush with each other for a generally seamless appearance. The straps 110 and 112 may be provided to have the same color and/or texture as that of the segments so as to camouflage their otherwise inconspicuous appearance. Alternatively, the hinges 80 may be covered with a quarter-round cover strip extending the length of the segments.

The view seen in FIG. 17 may be said to be a front view. The attachment of the straps 110 and 112 may accordingly be described as follows. One strap 110 is attached to a front edge (flange 42) of one elongate segment 32 and to a rear edge of the other elongate segment 34. The other strap 112 is attached to a rear edge of the one elongate segment 32 and to a front edge of the other elongate segment 34. The attachment of the straps to the front edges provides the first hinge axis 114, and the attachment of the straps to the rear edges provides the second hinge axis 116.

Each of the straps complements the other strap in maintaining the front or rear edges in an adjacent relationship for relative rotation of the segments about the edges, and this relationship is further stabilized by additional hinges along the length of the segments. The front edges (flanges 42) are pulled apart by relative rotation of the segments of substantially 180 degrees about axis 116 to the position shown in FIG. 16, the fronts (seen in FIG. 17) of the segments being indicated at 144.

Thus, there is provided a display system which may be lightweight and portable with the capabilities of being converted and used as three separate types of display system. Panels may be quickly and easily inserted and removed. A minimum of tooling is required for set-up and take-down. The hinges are provided to be rugged, reliable, inconspicuous and providing a seamless appearance, and allow relative panel rotation through substantially 360 degrees without being subject to breakage. Such a system is provided to be reliable, user friendly, and cost effective for the end user.

Although the invention has been described in detail herein, it should be understood that the invention can be embodied otherwise without departing from the principles thereof, and such other embodiments are meant to come within the scope of the present invention as defined in the appended claims.

What is claimed is:

1. Display apparatus comprising at least two panel frames each having a plurality of elongate segments connected together, each of said segments having a front edge and a rear edge, means for hingedly connecting one of said elongate segments of one of said frames to one of said elongate segments of another of said frames together for rotation of one of said frames relative to another of said frames through a maximum arc of substantially 360 degrees, said hinge means comprising at least one pair of straps composed of flexible material, means for attaching one of said straps to said front edge of said one elongate segment and said rear edge of said other elongate segment, means for attaching another of said straps to said rear edge of said one elongate segment and said front edge of said other elongate segment whereby the attachment of said straps to said front edges defines a hinge axis about which the frames are rotatable through a first arc and the attachment of said straps to said rear edges defines a hinge axis about which the frames are rotatable through a second arc, wherein at least one of said attaching means comprises means defining a cut-out in each of said elongate segments, means comprising an insert in said cut-out means, and means for tightly securing said insert in said cut-out means with an end portion of said respective strap pinchingly attached between said insert and said respective cut-out means, wherein said elongate segments have outer surfaces, said cut-out means extends across said respective outer surface between said front edge and said rear edge, and said insert has a surface which conforms to and replaces a portion of said respective outer surface removed for said cut-out means.

2. Apparatus according to claim 1 wherein each said elongate segment has a pair of wall portions, said securing means comprising a pair of leg portions which extend between said pair of wall portions of said respective elongate segment when said insert is inserted in said cut-out means and screw means for pinching said leg portions between said screw means and said wall portions for tightly securing said insert and said respective strap.

3. Apparatus according to claim 1 where said insert includes a plate portion which has said surface and a pair of edges, one of said edges being ridgeless for receiving said respective strap between said one edge and said cut-out means, said insert having a ridge portion along an other of said edges which is normal to said plate portion.

4. Apparatus according to claim 1 wherein said straps are composed of a cloth material.

5. Apparatus according to claim 1 wherein said straps are composed of vinyl.

6. Apparatus according to claim 1 wherein said at least one pair of straps comprises at least two pairs of said straps spaced over the length of said elongate segments.

7. Apparatus according to claim 1 wherein said plurality of elongate segments include means defining at least one slot extending along the perimeter of said frame for receiving edges of a panel, at least one of said elongate segments comprising a first elongate member secured to others of said plurality of elongate segments and adapted to provide an opening to said slot for insertion of the panel and further comprising a second elongate member removably attachable to said first elongate member and including means for closing the opening and adapted to define with said first elongate member a portion of the slot means.

8. Display apparatus comprising at least two panel frames each having a plurality of elongate segments connected together, each of said segments having a front edge and a rear edge, means for hingedly connecting one of said elongate segments of one of said frames to one of said elongate segments of another of said frames together for rotation of one of said frames relative to another of said frames through a maximum arc of substantially 360 degrees, said hinge means comprising at least one pair of straps composed of a flexible material, means for attaching one of said straps to said front edge of said one elongate segment and said rear edge of said other elongate segment, means for attaching another of said straps to said rear edge of aid one elongate segment and said front edge of said other elongate segment whereby the attachment of said straps to said front edges defines a hinge axis about which the frames are rotatable through a first arc and the attachment of said straps to said rear edges defines a hinge axis about which the frames re rotatable through a second arc, wherein said plurality of elongate segments include means defining at least one slot extending along the perimeter of said frame for receiving edges of a panel, at least one of said elongate segments comprising a first elongate member secured to others of said plurality of elongate segments and adapted to provide an opening to said slot for insertion of the panel and further comprising a second elongate member removably attachable to said first elongate member and including means for closing the opening and adapted to define with said first elongate member a portion of the slot means.

9. Apparatus according to claim 8 comprising at least one first set of said panel frames, at least one second set of said panel frames, a plurality of header frames, and means for interchangeably connecting said header frames and said first and second sets of panel frames so that the header frames are optionally above, between, or below the first and second sets of panel frames.

10. A frame for holding a panel for a display system comprising a plurality of edge means connected together and including at least one slot means extending along the perimeter of the frame for receiving edges of the panel, at least one of said edge means comprising a first elongate member secured to others of said plurality of edge means to hold the frame together and adapted to provide an opening to said slot means for insertion of the panel, and said at least one edge means further comprising a second elongate member which extends alongside of and which is removably attachable to said first elongate member and including means for closing the opening and adapted to define with said first elongate member a portion of said slot means whereby removal of the second elongate member allows insertion of the panel.

11. A frame for holding a panel for a display system comprising a plurality of edge means connected together and including at least one slot means extending along the perimeter of the frame for receiving edges of the panel, at least one of said edge means comprising a first elongate member secured to others of said plurality of edge means and adapted to provide an opening to said slot means for insertion of the panel and further comprising a second elongate member removably attachable to said first elongate member and including means for closing the opening and adapted to define with said first elongate member a portion of said slot means, the frame further comprising means including a plurality of members for connecting said edge means together and means for connecting said first elongate member to respective ones of said plurality of members independently of said second elongate member.

12. A frame according to claim 11 wherein said plurality of members each has a pair of legs, and means for detachably attaching said legs to respective ones of said edge means.

13. A frame for holding a panel for a display system comprising a plurality of edge means connected together and including at least one slot means extending along the perimeter of the frame for receiving edges of the panel, at least one of said edge means comprising a first elongate member secured to others of said plurality of edge means and adapted to provide an opening to said slot means for insertion of the panel and further comprising a second elongate member removably attachable to said first elongate member and including means for closing the opening and adapted to define with said first elongate member a portion of said slot means, the frame further comprising means including a plurality of members for connecting said edge means together, said first elongate member including elongate channel means for receiving said members, and said second elongate member including at least one flange means disposable, when said first and second elongate members are connected, for receiving an edge of the panel between said flange means and said channel means.

14. A frame according to claim 13 further comprising means for locating said second elongate member relative to said first elongate member.

15. A frame according to claim 14 wherein said locating means comprises ridge means extending along the length of one said first and second elongate members and notch means extending along the length of an other of said first and second elongate members for receiving said ridge means.

16. A frame according to claim 15 wherein said notch means is disposed on said first elongate member and comprises a pair of elongate notches on opposite corners thereof which face said second elongate member.

* * * * *

UNITED STATES PATENT AND TRADEMARK OFFICE

CERTIFICATE OF CORRECTION

PATENT NO. : 5,603,370
DATED : 2/18/97
INVENTOR(S) : Edmond J. Boer

It is certified that error appears in the above-indentified patent and that said Letters Patent is hereby corrected as shown below:

Col. 9, line 49 - "aid" should be --said--.

Col. 9, line 55 - "re" should be --are--.

Signed and Sealed this

First Day of July, 1997

Bruce Lehman

*Attest:*

BRUCE LEHMAN

*Attesting Officer*

*Commissioner of Patents and Trademarks*